United States Patent [19]

Kinosz et al.

[11] Patent Number: 4,767,598

[45] Date of Patent: Aug. 30, 1988

[54] INJECTION APPARATUS FOR INTRODUCTION OF A FLUID MATERIAL INTO A MOLTEN METAL BATH AND ASSOCIATED METHOD

[75] Inventors: Michael J. Kinosz, Apollo; Alan P. Mitchell, Templeton, both of Pa.

[73] Assignee: Aluminum Company of America, Pittsburgh, Pa.

[21] Appl. No.: 910,450

[22] Filed: Sep. 22, 1986

[51] Int. Cl.[4] ..... C22B 21/04

[52] U.S. Cl. ..... 420/528; 75/68 R; 266/47; 266/221; 266/267; 420/590

[58] Field of Search ..... 420/129, 528, 590; 75/68 R; 266/221, 267, 47; 425/7; 264/12

[56] References Cited

U.S. PATENT DOCUMENTS

| | | | |
|---|---|---|---|
| 3,207,597 | 9/1965 | Hashimoto et al. | 266/267 |
| 3,608,881 | 9/1971 | Yordanov et al. | 266/267 |
| 4,248,630 | 2/1981 | Balmuth | 420/528 |
| 4,295,883 | 10/1981 | Lajh | 75/68 R |

*Primary Examiner*—Christopher W. Brody
*Assistant Examiner*—Robert L. McDowell
*Attorney, Agent, or Firm*—Arnold B. Silverman

[57] ABSTRACT

An injection apparatus for introducing fluid material, such as a reactive element to a molten metal bath while resisting undesired oxidation. The injection apparatus consists of a body assembly having a chamber defined therein, and inlet and outlet passageways communicating with the chamber which cooperate to define a passageway therethrough. The lower end of the outlet extends below the surface of the molten metal bath. Purging gas is introduced through a gas inlet and provide a substantially purged atmosphere throughout the molten metal passageway. The atmosphere in the passageway is purged in order that the fluid material can be safely introduced into the molten bath. The injection apparatus is readily assembled and disassembled by means of a unique clamping device employed with the body assembly.

20 Claims, 5 Drawing Sheets

INJECTION APPARATUS FOR INTRODUCTION OF A FLUID MATERIAL INTO A MOLTEN METAL BATH AND ASSOCIATED METHOD

BACKGROUND OF THE INVENTION

1. Field Of The Invention

This invention relates to an injection apparatus for introducing a fluid material into a molten metal bath and an associated method.

2. Description Of The Prior Art

While it has been known that the addition of reactive metallic elements such as lithium or sodium to a molten metal bath, particularly aluminum and aluminum based alloys may enhance the properties of the molten metal, attention must be directed toward safety considerations. Such reactive elements have a tendency to oxidize the alloy during processing and, as a result, can present a risk of explosion.

U.S. Pat. No. 4,248,630 discloses a method of making an aluminum alloy containing a highly reactive metallic element, such as lithium. The method uses a bath of molten aluminum where all of the alloying elements, except for the highly reactive metallic element are added initially to create an alloy melt. The alloy melt is degassed and the reactive metallic element is then added to the alloy melt by passing it through a transfer tube which is a metal shell lined with a refractory or other material resisting attack by the molten lithium. The transfer tube is provided with a suitable valve disposed therein.

There remains a need for an improved apparatus and method for introducing a fluid material, such as an alloying constituent and, more specifically, reactive metallic elements into a molten metal bath in an efficient manner under safe conditions.

SUMMARY OF THE INVENTION

The above-described need has been met by the injection apparatus and method to be disclosed hereinafter. The injection apparatus comprises a body assembly which has a chamber defined therein, inlet and outlet passageways communicating with the chamber and a purging gas conduit for introducing purging gas into the chamber in order to facilitate movement of the fluid material into the molten metal bath. The outlet conduit is inserted into the molten metal bath. The body assembly is preferably provided with a quick disconnect coupling in order to facilitate rapid disassembly of the body assembly for replacement of the inlet conduit or the outlet conduit or other component parts.

The method may employ the above-described injection apparatus. Purging provides a generally air-free atmosphere in the body assembly which resists undesired oxidation of the reactive metallic element. After purging of the atmosphere in the body assembly chamber, the fluid material is introduced into the passageway and delivered to the molten metal bath.

It is a general object of this invention to provide an apparatus and associated method for efficiently and safely introducing a fluid material, such as a reactive metallic element into a molten metal bath.

It is another object of the present invention to provide such an apparatus and associated method which employs a quick disconnect coupling mechanism which facilitates rapid assembly and disassembly of the apparatus.

It is a further object of the present invention to provide such an apparatus and method which will purge the atmosphere of the passageway which transports a reactive metallic element to the molten metal bath of oxygen and thereby minimizes the risk of explosion.

It is another object of the present invention to provide a method of adding reactive metallic elements to the molten metal bath in which transport of the reactive metallic elements is effected in part by the purging gas.

It is a further object of the present invention to provide such injection apparatus which may be employed to produce a lithium-aluminum alloy and will be easy to maintain.

It is yet another object of the present invention to provide such an apparatus wherein the component parts are intimately secured in a desired predetermined relative relationship while rapid and easy disassembly and replacement of parts is facilitated.

These and other objects of the invention will be more fully understood from the following description of the invention on reference to the illustrations appended hereto.

DESCRIPTION OF THE PREFERRED EMBODIMENTS

Figure 1:
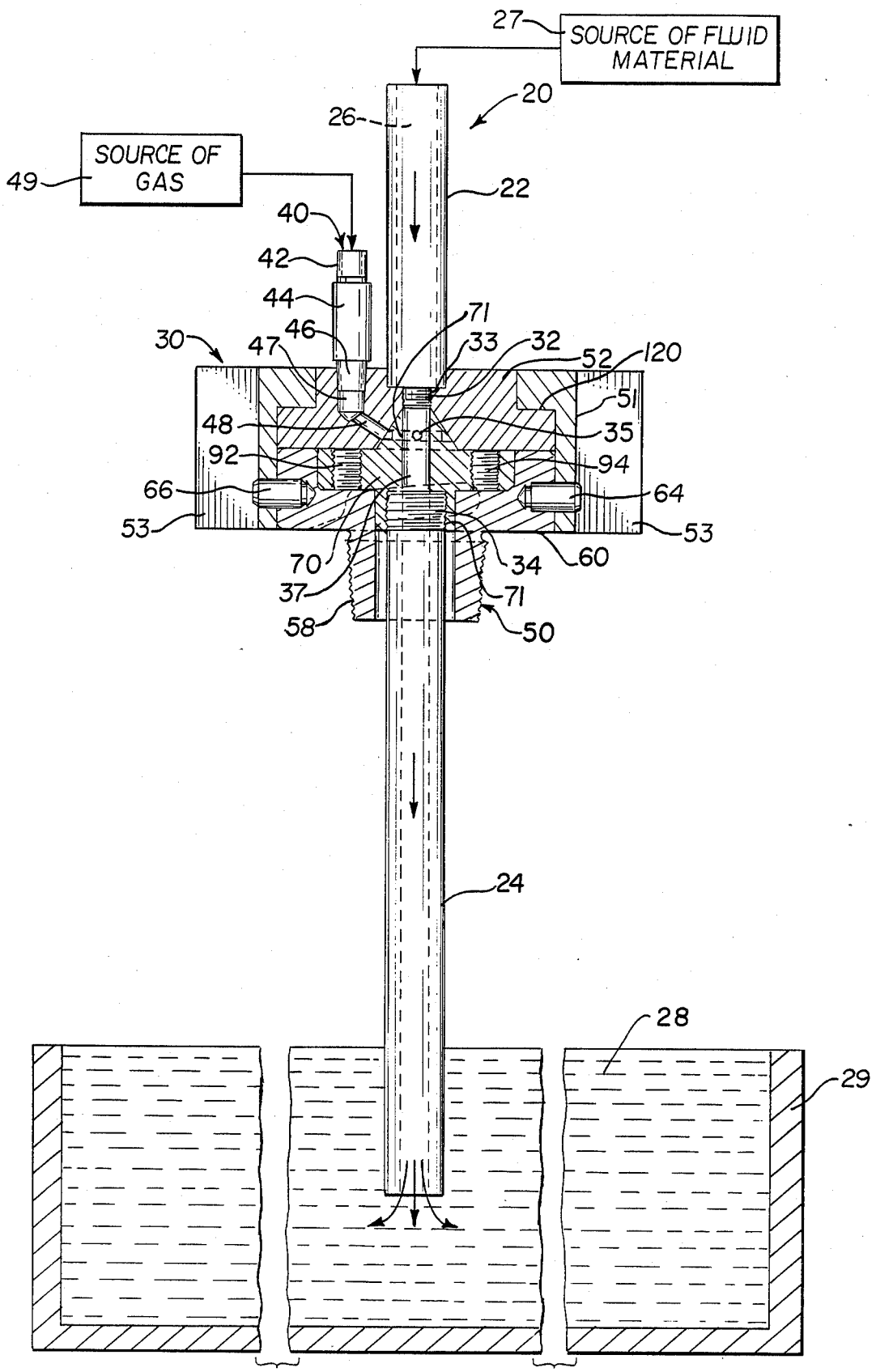
FIG. 1 is a cross-sectional illustration of a form of an injection apparatus of the present invention.

Referring more specifically to FIG. 1, there is shown a preferred form of an injection apparatus 20. The apparatus has an inlet 22 and an outlet 24 and a body assembly 30 which cooperates with the inlet 22 and the outlet 24 to define a continuous passageway 26 through the apparatus. This passageway 26, in a manner to be described in detail hereinafter serves to deliver a fluid material from a suitable source such as a reservoir 27 to a molten metal bath 28 which is contained within a bath receiving vessel 29.

In the form shown the injection apparatus 20 is disposed in a generally vertical orientation with the outlet 24 extending into the molten metal bath 28. The injection apparatus 20 may be positioned as shown in FIG. 1 either while the vessel 29 is empty or after the molten metal has been introduced into the vessel 29. In general, it will be preferable to have a suitable cover member (not shown) provided on the vessel 29.

The inlet 22, the outlet 24 and other assembly components which may come into contact with the fluid material or base metal are preferably composed of a material that is not attacked by the fluid material, the base metal or the resultant alloy. Among the materials which are preferred for use in the injection apparatus 20 are stainless steel or ceramic materials. An example of a suitable stainless steel for use with fluid material such as lithium is a non-magnetic 304 or 316 stainless steel. Copper or carbon steel are also suitable when using less corrosive fluid materials. An example of a suitable ceramic material is silicon carbide molite or high alumina refractory. The inner walls of both the inlet 22 and the outlet 24 are preferably provided with a refractory lining.

In order to reduce the likelihood of undesired problems caused by differences in thermal expansion and contraction, it is preferred that the inlet 22, the outlet 24 and a body assembly 30, as well as other component parts be composed of the same materials. The avoidance of differences in thermal expansion and contraction of the various parts serves to resist undesired leakage of the fluid material as well as gasses passing through the injection apparatus 20.

The body assembly 30 is interposed between the inlet 22 and outlet 24 and serves to facilitate efficient flow of the fluid material from a fluid source to the molten metal bath 28. It also provides for introduction of an inert gas into the fluid flow passageway 26.

As is shown in FIG. 1, the inlet 22 has a reduced diameter lower portion 32 which is externally threaded. This portion 32 is threadedly secured to the body assembly 30. Similarly, the upper portion of the outlet 24 has an externally threaded portion 34 which is threadly secured to the body assembly 30. The body assembly 30 defines a chamber 37 having an aperture 35 formed therein. The chamber 37 is in communication with both inlet 22 and the outlet 24 to define the continuous passageway 26. In this manner, fluid material from the reservoir 27 may be transported in a closed system under the influence of pressure or gravity or both directly to a position under the surface of the molten metal bath 28.

The presence of oxygen in the passageway 26 when the fluid material is a potentially hazardous material such as lithium can result to undesired oxidation of the lithium and a significant safety risk due to the possibility of an explosion. The present invention minimizes the risk of such an accident by introducing an inert gas into the passageway 26 to purge air or oxygen therefrom. The inert gas also serves to prevent undesired clogging of the passageway 26. Any suitable inert gas such as argon may be employed for this purpose.

A gas inlet 40 is preferably in sealed communication with a gas source 49 and has a nipple 42, a tube 44, a reduced diameter portion 46, and connecting passageways 47 and 48. The passageway 48 is in communication with the passageway 26 through the aperture 35.

It will be appreciated, that in this manner, the introduction of the inert gas and the delivery of the fluid material may be coordinated within a sealed system in an efficient manner which resists clogging and reduces safety hazards caused by the presence of oxygen in the passageway 26.

In order to enhance the efficiency of delivery of the fluid material it is preferred that the inlet and outlet conduits 22 and 24, respectively, be heated and thermally insulated in order to facilitate maintaining the molten state of the fluid material. Electrical resistant heating elements (not shown) may be placed around the exterior of the conduits 22 and 24. For example, 110 volt heaters supplying about 40 to 50 watts per linear foot of conduit may be employed. The heater may advantageously be sheathed with stainless steel shim stock and wrapped around the exterior of the inlet 22 with a thermally insulating blanket and duct tape. It is preferred that the thermally insulating blanket provide about three inches of thermal insulation. Suitable thermal insulation materials for this purpose are those sold under the trade designations Fiberfax or Serafax.

It is preferred that the temperature of the inlet 22, the outlet 24 and the body assembly 30 be maintained at a level above the melting temperature of the fluid material. When lithium is the fluid material, the temperature should be at least about 360 degrees F. and preferably between about 500 degrees F. and 560 degrees F. The radiant and conductive heat from the molten metal bath 28 and a cover (not shown) will maintain the desired temperature at the lower end of outlet 24. In this manner, resistance to undesired solidification of the fluid material is accomplished. It is generally preferred that the outlet 24 have a diameter which is equal to or smaller than the diameter of the inlet 22. The inlet 22 preferably has an outside diameter of about $\frac{3}{4}$ of an inch and a wall thickness of about 0.065 inches. The outlet 24 preferably has an outside diameter about $\frac{3}{8}$ of an inch and a wall thickness of about $\frac{1}{8}$ of an inch. Referring still to FIG. 1, details of the body assembly 30 will be considered. The body assembly 30 has an adapter 50, an overlying seal plate 52 and an interposed seal 70. A clamp assembly 51 which facilitates locking and unlocking the body assembly 30 is also provided.

The seal plate 52 has a generally circular shape in plan view and a stepped cross-sectional configuration in elevation with the larger diameter portion being disposed under the smaller diameter portion. A generally centrally disposed recess 54 (FIGS. 2 and 3) receives the lower end of the inlet conduit 22 which may be secured to the seal plate 52 by any desired means. The inlet 22, in the form shown, is substantially coaxial with the body assembly chamber 37 and the outlet 24. The inert gas delivering passageway 48 passes through the seal plate 52 at a position laterally offset from the passageway 26 and is in communication with the passageway 26 at the aperture 35.

Figure 2:
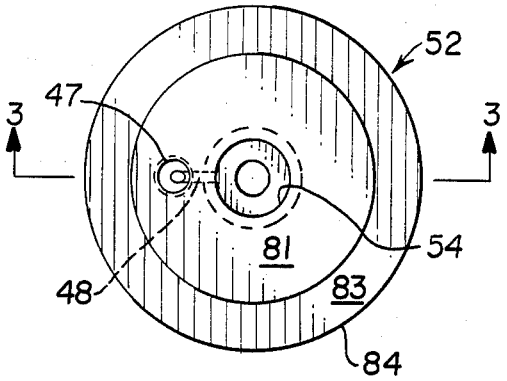
FIG. 2 is a top plan view of a seal plate of the injection apparatus of FIG. 1.
Figure 4:
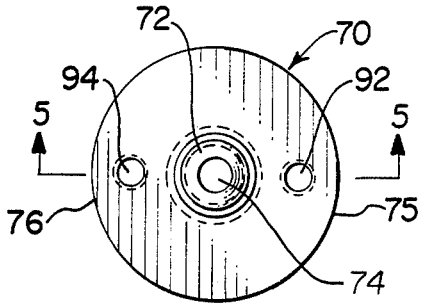
FIG. 4 is a top plan view of a seal of the injection apparatus of FIG. 1.
Figure 3:
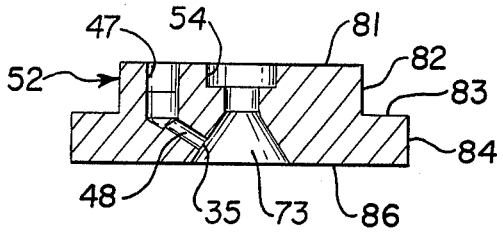
FIG. 3 is a cross-sectional view of the seal plate of FIG. 2 taken through line 3—3.
Figure 5:
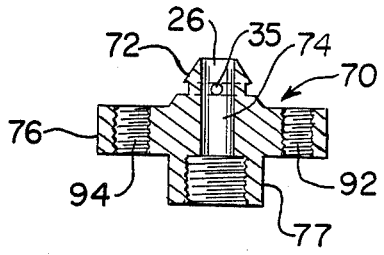
FIG. 5 is a cross-sectional illustration of the seal of FIG. 4 taken through line 5—5.

As is shown in FIGS. 2 and 3, the seal plate 52 has an upper surface 81, a pair of annular surfaces 82 and 83 cooperating to define a step, an annular lateral surface 84 and a lower surface 86.

Figure 6:
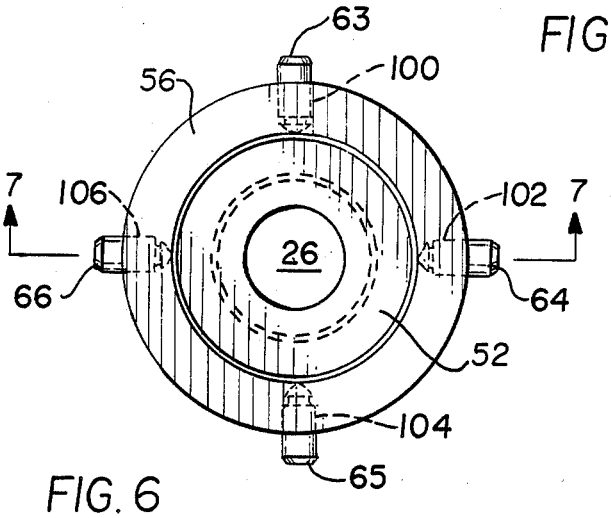
FIG. 6 is a top plan view of a form of adapter of the injection apparatus illustrated in FIG. 1.
Figure 7:
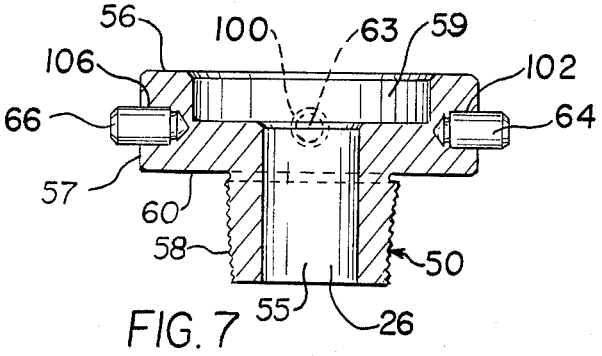
FIG. 7 is a cross-sectional view of the adapter of FIG. 6 taken through line 7—7.
Figure 8:
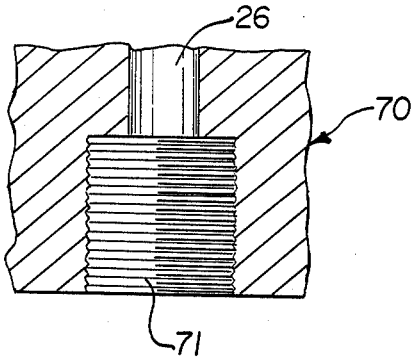
FIG. 8 is a fragmentary cross-sectional illustration of a portion of the seal of FIG. 5.

Referring to FIGS. 1, 6 and 7, details of the adapter 50 will be considered. The adapter 50 has an annular upper surface 56, an upper lateral surface 57, an intermediate annular surface 60 and a lower tubular externally threaded annular surface 58. An upper bore 59 has an enlarged diameter with respect to lower bore 55 both of which form a portion of the chamber which is part of the passageway 26. Upper surface 56 of the adapter 50 is in underlying surface-to-surface contact with the seal plate 52. Extending into the annular lateral surface 57 are a series of four recesses 100, 102, 104, 106 within which are fixedly secured, respectively, pins 63, 64, 65, 66. The pins 63–66 project outwardly in a radial direction. The pins 63–66 serve as part of a clamp assembly which will be described hereinafter. The annular surface 58 of the adapter 50 is externally threaded to facilitate securement of the injection apparatus 20 to a support member such as a threaded aperture in a cover (not shown).

Interposed between the seal plate 52 and the adapter 50 is the seal 70 which is best illustrated in FIGS. 1, 4, 5 and 8. The seal 70 has a central bore 74 which forms part of passageway 26 and has a passageway 71 which connects the passageway 48 with the passageway 26 through the aperture 35. An upper frusto-conical portion 72 (see FIG. 5) is received within a tapered enlargement 73 (FIG. 3) formed in the downwardly open seal plate. The seal 70 has a lateral annular projection 76 and a pair of threaded generally vertically oriented bores 92, 94. Should the seal 70 become immobilized due to freezing of fluid material, the axial bores 92, 94 will permit a rod to be threaded therein so as to facilitate removal of the seal 70. A lower portion 77 of the seal 70 is tubular and has an internally threaded bore 71 which is adapted to be threadedly connected to the upper end of the outlet 24.

Referring in greater detail to FIGS. 1, 6, 7, 9 and 10, details of a removable clamp assembly 51 will be considered. One of the prime advantages of the injection apparatus 20 is the quick disconnect feature which permits rapid assembly or disassembly thereof. This facilitates replacement of the inlet 22, the outlet 24 or other parts in a manner which does not require prolonged shutdown of the system.

Figure 9:
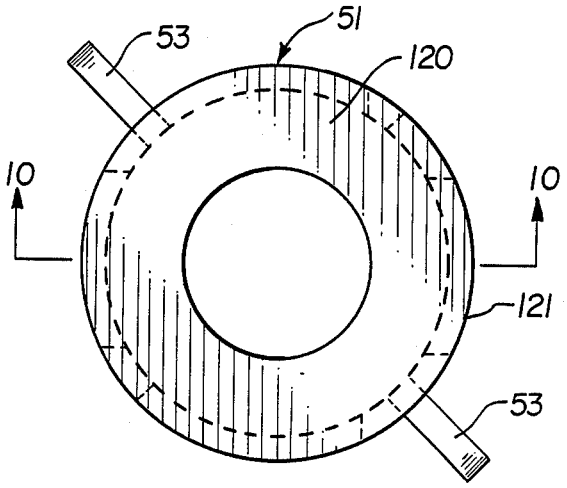
FIG. 9 is a top plan view of a clamp sleeve of the injection apparatus of FIG. 1.
Figure 10:
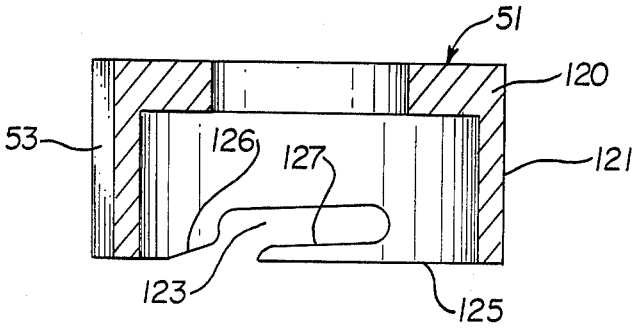
FIG. 10 is a cross-sectional view of the clamp of FIG. 9 taken through line 10—10.
Figure 11:
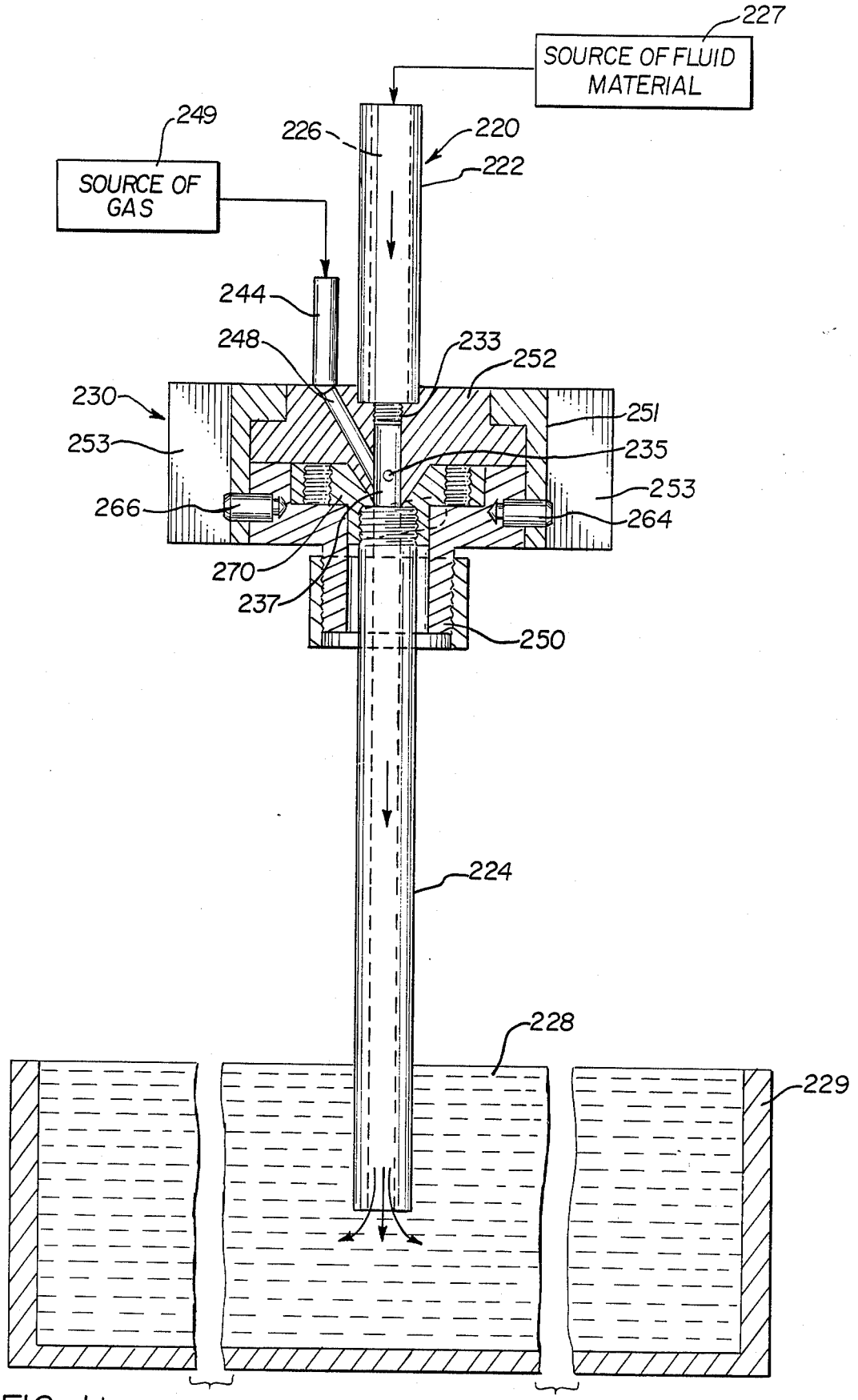
FIG. 11 is a cross-sectional illustration of an alternate embodiment of the injection apparatus of the present invention.

Referring to FIGS. 9 and 10, the clamp assembly 51, in the form shown, has an upper radially inwardly projecting annular flange 120 and an annular collar portion 121. A lower portion of the collar 121 has a plurality of slots 123 formed therein which are generally circumferentially oriented. Each of the slots 123 is defined by an upper wall portion 126 and a lower wall portion 127. Each slot 123 is in communication with a lower edge 125 of the collar. The inner and lower walls 126, 127 provide a cam which as will be discussed hereinafter permit effective locking and unlocking of the clamp assembly 51. Projecting generally radially outwardly from the collar 121 are a pair of wings 53 (FIG. 9) which are generally coextensive in height with the clamp assembly 51.

Each slot 123 is adapted to cooperate with one of the pins 63, 64, 65, 66 which project radially from the adapter 60 (See FIGS. 6 and 7). In the embodiment illustrated, four such pins 63, 64, 65, 66 are each adapted to cooperate with one of four slots 123 (the three additional slots which have not been shown are spaced circumferentially so as to cooperate with the pins). In effecting locking engagement between the clamp assembly 51 and the remaining portions of the body assembly 30, the pins 63–66 are placed in the openings of each of the respective slots 123 and rotation of the clamp assembly 51 is effected in the direction which will cause the pins 63–66 to move toward the closed end of the slot 123. As a result of the sloping surfaces of the upper and lower walls 126 and 127, the pins are readily introduced into the opening of slot 123 and a camming action is created to establish locking. Unlocking is effected by rotating the clamp assembly 51 in the opposite direction such that the pins 63, 64, 65, 66 move out of the respective slots 123.

While four pins 63–66 have been illustrated, other numbers of pins may be employed. It is preferred that at least two pins be employed.

As is shown in FIG. 1, when the clamp assembly 51 is in the locked position, the annular flange 120 is positioned within the step defined by the surfaces 82, 83 of the seal plate 52 (See FIG. 3). In order to facilitate manual rotation of the clamp assembly 51, the wings 53 may be engaged manually in order to effect the desired degree of rotation. It will be appreciated that the clamp assembly 51 provides a rapid and effective means for locking or unlocking the body assembly 30 to permit part replacement or other desired access to components of the injection apparatus 20.

In the method of the present invention which may employ the apparatus illustrated in FIGS. 1 through 10, after the outlet 24 has been inserted into the molten metal bath 28, an atmosphere generally purged of air is provided in the body assembly chamber 37 by introducing the inert gas through the gas inlet 40. Subsequently, the fluid material is delivered through passageway 26 to the molten metal bath 28. In general, the molten metal bath 28 will contain a metallic element such as aluminum or an alloy thereof and the fluid material introduced may be lithium. The purging gas is preferably introduced at a temperature equal to or higher than the melting temperature of the fluid material.

If there is a high metal head and back pressure in the inlet conduit 22, the purging gas assists the movement of the fluid material through the passageway 26. This in turn aids in the mixing of the fluid material and the molten metal in the molten bath 28. Preferably the purging gas flow is at about 30 cubic feet per hour (cfh). It is preferred that the purging gas be introduced into the passageway 26 prior to the introduction of the fluid material into the passageway 26. Also, it is preferable to heat the purging gas to about the same temperature as the fluid material being introduced in the passageway 26 in order to resist freezing of the fluid material in the passageway 26.

Referring to FIGS. 11 through 15, a modified injection apparatus 220 is illustrated. In this injection apparatus 220 a slightly modified seal plate 252 and the seal 270 are provided. As was true with the first embodiment, an inlet 222 and an outlet 224 provide a means for fluid material to flow into a molten metal bath 228 which is disposed within a suitable vessel 229. A reservoir 227 of the fluid material preferably has a sealed connection to the inlet 222. A body assembly 230 has a chamber 237 which cooperates with the inlet 222 and the outlet 224 to provide a continuous passageway 226 for the flow of fluid material into the molten metal bath 228. The inlet 222 has a reduced diameter externally threaded portion 233 which facilitates securement of the inlet 222 to the body assembly 230.

A source of inert gas 249 has a sealed connection to gas inlet tube 244 which in turn is in communication with passageway 248 within the seal plate 252. Gas passing through the passageway 248 enters the passageway 226 through an opening 235.

Figure 12:
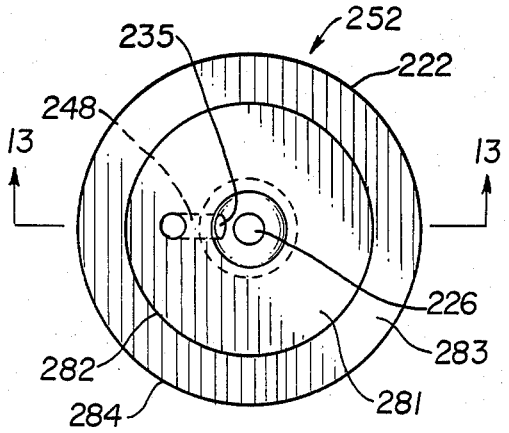
FIG. 12 is a top plan view of a form of seal plate of the injection apparatus of FIG. 11.
Figure 13:
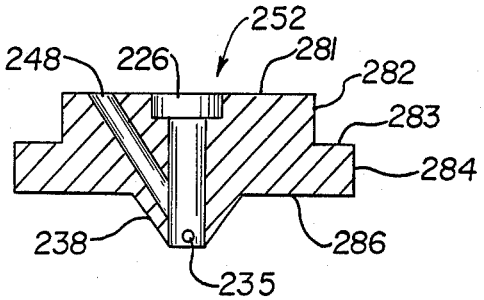
FIG. 13 is a cross-sectional view of the seal plate of FIG. 12 taken through line 13—13.

Referring to FIGS. 12–13, it is seen that the body plate 252 has an upper surface 281 and a stepped lateral surface defined by surfaces 282, 283, 284 along with a lower surface 286. The seal plate 252 has a downwardly projecting generally centrally disposed frusto-conical portion 238.

Figure 14:
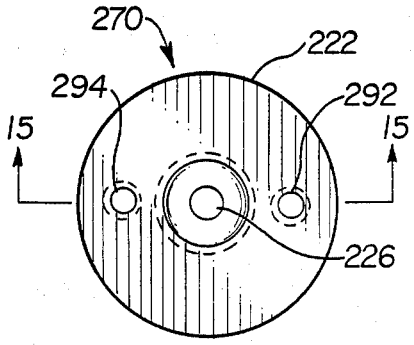
FIG. 14 is a top plan view of the seal employed in the embodiment of FIG. 11.
Figure 15:
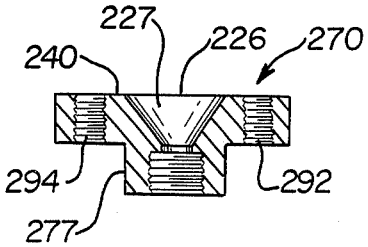
FIG. 15 is a cross-sectional view of the seal of FIG. 14 taken through line 15—15.

Referring to FIGS. 14 and 15, it will be noted that the seal 270 of this embodiment has an upwardly and generally outwardly tapered recess 227, an upper surface 240, threaded bores 292, 294 and an internally threaded downwardly extending tubular portion 277. It will be appreciated that the frustoconical portion 238 of the seal plate 252 will be received within the recess 227 of the seal 270.

Referring again to FIG. 11, a clamp assembly 251 is shown which cooperates with a series of pins 264, 266 (two such pins have not been illustrated in this view) for it to be effected in the manner of the first embodiment. The preferred wings 53 (FIGS. 1, 9 and 10) are not shown in this view but may be employed if desired.

In operation of the injection apparatus 220, as with the first embodiment, a predetermined amount of fluid material is introduced into the passageway 226 from the reservoir 227 where it flows through the inlet conduit 222, and the remainder of the passageway 226 into the molten metal bath 228, preferably under the influence of pressure. The pressure provided should be sufficient to overcome any head pressure in the fluid material. The purging gas may assist in moving the fluid material through the passageway 226 into the molten metal bath 228 wherein mixture of the fluid material with the molten metal bath is effected.

It will be appreciated that the present invention has provided an injection apparatus and an associated method that resists undesired clogging of the fluid material, avoids the risk of explosion when highly reactive materials are employed, provides a continuous closed system for efficient delivery of a fluid material from a reservoir to a molten metal bath. The apparatus is such that the assembly body is easily locked and unlocked in order to facilitate replacement of parts. This quick coupling and uncoupling action can save a run by permitting replacement of the outlet conduit during actual casting without altering the content of the final alloy. As a result of the use of purging gas the injection apparatus resists undesired oxidation of the alloy and its components. The injection apparatus has component parts which are easily assembled, disassembled, replaced and maintained.

While the invention has been described in conjunction with a specific embodiment, it is to be understood that many alternatives, modifications and variations will be apparent to those skilled in the art in light of the/a foregoing description. Accordingly, this invention is intended to embrace all such alternatives, modifications and variations which fall within the spirit and scope of the appended claims.

We claim:

1. An injection apparatus for introduction of a fluid material into a molten metal bath comprising:

a body assembly having a chamber defined therein;

inlet and outlet passageways communicating with said chamber;

said inlet and outlet passageways being demountably secured to said body assembly, whereby said passageways may readily be separated from said body assembly, said body assembly having a seal plate through which a portion of said chamber passes, means for introducing a purging gas into said chamber for mixing with said fluid material therein and said molten metal bath, and said purging gas introducing means having a gas inlet conduit in communication with said chamber.

2. An injection apparatus for introduction of a fluid material into a molten metal bath comprising:

a body assembly having a chamber defined therein;

inlet and outlet passageways communicating with said chamber;

means for introducing a purging gas into said chamber to facilitate movement of said fluid material into said molten metal bath, said body assembly has a seal plate through which a portion of said chamber passes, said purging gas introducing means has a gas inlet conduit in communication with said chamber, and said gas inlet conduit passes through said seal plate.

3. The injection apparatus of claim 2 wherein said body assembly has adapter means disposed in underlying relationship with respect to said seal plate for receiving a portion of said outlet passageway.

4. The injection apparatus of claim 3 wherein said body assembly has seal means interposed between said seal plate and said adapter means for effecting a seal therebetween.

5. The injection apparatus of claim 4 wherein said body assembly has removable clamp means for securing said seal plate, said seal means and said adapter means in relative assembled position.

6. The injection apparatus of claim 5 wherein said clamp means has a rotatable sleeve in surrounding relationship with respect to said seal plate, said seal means and said adapter means; and said sleeve is rotatable in a first direction to secure said body assembly in locked position and rotatable in an opposite direction to unlock said body assembly.

7. An injection apparatus for introduction of a fluid material into a molten metal bath comprising:

a body assembly composed of a plurality of component parts and having a chamber defined therein;

means for introducing a purging gas into said chamber to facilitate movement of said fluid material through said chamber and into said molten metal bath, inlet and outlet passageways communicating with said chamber;

said plurality of component parts inlcuding a seal plate through which a portion of said chamber adjacent to said inlet passageway passes and adapter means disposed in underlying relationship with respect to said seal plate for receiving a portion of said outlet passageway, said body assembly having removable clamp means securing said component parts in position and said outlet passageway being threadedly secured to said body assembly, whereby said outlet passageway may be rapidly disconnected from said body portion and replaced.

8. The injection apparatus of claim 7 wherein said clamp means has a sleeve member disposed in generally surrounding relationship with respect to said component parts;

said sleeve has generally circumferentially oriented elongated slot means; and said body assembly has pin means projecting generally radially outwardly therefrom and passing through said slot means, whereby rotation of said sleeve in a first direction will lock said body assembly and rotation in an opposite direction will unlock said body assembly.

9. The injection apparatus of claim 8 wherein said component parts include a seal plate having a portion of said chamber passing therethrough;

said means introduce purging gas into said body assembly passing through said seal plate;

adapter means underlying said seal plate; and seal means are interposed between said seal plate and said adapter means.

10. The injection apparatus of claim 9 wherein said sleeve has a generally radially inwardly directed flange in overlying relationship with respect to a portion of said seal plate; and said generally circumferential slots are disposed adjacent to said adapter means.

11. The injection apparatus of claim 12 wherein said pin means have at least two cirumferentially spaced generally radially projecting pins.

12. The injection apparatus of claim 11 wherein said slot means have cam means for cooperating with said pins to provide locking and unlocking action.

13. The injection apparatus of claim 11 wherein said pins are fixedly secured to said adapter means.

14. A method of introducing a fluid material into a molten metal bath comprising the steps of providing an injection apparatus having a body assembly with a chamber defined therein, an inlet, an outlet and a gas inlet cooperating with said body assembly wherein said inlet and said outlet cooperate with said body assembly chamber to form a passageway therethrough, said outlet being secured to said body assembly in a manner which permits rapid separation of said outlet from the rest of said injection apparatus and rapid replacement of said outlet, establishing an atmosphere generally purged of air in said body assembly chamber through introduction of a purging gas through said gas inlet into said body assesmbly chamber, introducing said fluid material into said passageway routing said fluid material into said molten metal bath, and subsequently separating said outlet from the remainder of said injection apparatus.

15. The method of claim 14 wherein said fluid material is a metallic element.

16. The method of claim 15 wherein said molten metal is aluminum, and said outlet is emersed (submerge) in said molten aluminum bath.

17. The method of claim 14 wherein said body assembly has a plurality of parts including a seal plate through which a portion of said chamber passes, an adapter disposed in underlying relationship with respect to said seal plate and seal means interposed between said seal plate and said adapter means with said plurality of parts being secured by removable clamp means, and effecting locking of said body assembly prior to establishing said atmosphere and introducing said fluid material into said passageway.

18. A method of introducing a fluid material into a molten metal bath comprising the steps of providing an injection apparatus having a body assembly with a chamber defined therein, an inlet, an outlet and a gas inlet all cooperating with said body assembly wherein said inlet and said outlet cooperate with said body assembly chamber to form a passageway therethrough, establishing an atmosphere generally purged of air in said body assembly chamber through introduction of a purging gas through said gas inlet into said body assembly chamber, introducing said fluid material into said passageway, routing said fluid material into said molten metal, said fluid material is a metallic element, and said element is lithium.

19. The method of claim 18 wherein said molten metal is aluminum.

20. A method of introducing a fluid material into a molten metal bath comprising the steps of providing an injection apparatus having a body assembly with a chamber defined therein, an inlet, an outlet and a gas inlet all cooperating with said body assembly wherein said inlet and said outlet cooperate with said body assembly chamber to form a passageway therethrough, establishing an atmosphere generally purged of air in said body assembly chamber through introduction of a purging gas through said gas inlet into said body assembly chamber, introducing said fluid material into said passageway, routing said fluid material into said molten metal, said fluid material is a metallic element, said outlet is emersed in said molten aluminum bath, and said purging gas is at about the temperature of said fluid material.

* * * * *

UNITED STATES PATENT AND TRADEMARK OFFICE

CERTIFICATE OF CORRECTION

PATENT NO. : 4,767,598

DATED : August 30, 1988

INVENTOR(S) : MICHAEL J. KINOSZ and ALAN P. MITCHELL

It is certified that error appears in the above-identified patent and that said Letters Patent is hereby corrected as shown below:

Claim 1, Column 7, line 67, --to facilitate movement of said fluid material into-- should be inserted before "said".

Claim 20, column 10, line 47, "aluminum" should be deleted.

Signed and Sealed this

Twenty-ninth Day of August, 1989

*Attest:*

DONALD J. QUIGG

*Attesting Officer*

*Commissioner of Patents and Trademarks*